United States Patent [19]

Hollingsworth et al.

[11] 4,148,273

[45] Apr. 10, 1979

[54] MEDICINE MANAGEMENT DEVICE

[76] Inventors: Delbert L. Hollingsworth, Rte. #6, Box 321, Leesburg, Fla. 32748; Vance R. Sharp, 109 Balsam Rd., Oak Ridge, Tenn. 37830

[21] Appl. No.: 833,250

[22] Filed: Oct. 17, 1977

Related U.S. Application Data

[63] Continuation of Ser. No. 721,092, Sep. 7, 1976, abandoned.

[51] Int. Cl.[2] ..... B65D 85/56; G09F 9/00

[52] U.S. Cl. ..... 116/325; 206/534

[58] Field of Search ..... 116/121, 136; 206/538, 206/539, 534

[56] References Cited

U.S. PATENT DOCUMENTS

| | | | |
|---|---|---|---|
| 400,345 | 3/1889 | Kennedy | 116/136 |
| 1,665,568 | 4/1928 | Spiegel | 116/136 |
| 1,853,076 | 4/1932 | Mygaard | 116/136 |
| 3,195,813 | 7/1965 | Hart | 116/136 |
| 3,225,913 | 12/1965 | Lee | 206/534 X |
| 3,278,010 | 10/1966 | Katz | 206/539 X |
| 3,675,620 | 7/1972 | Baustin | 116/121 |
| 3,841,260 | 10/1974 | Sharp et al. | 116/136 |

*Primary Examiner*—Daniel M. Yasich

*Attorney, Agent, or Firm*—Herman L. Holsopple

[57] ABSTRACT

A device is described whereby persons required to take one or more doses of a plurality of medicines, over a span of hours and days can keep track of times said dosages should be taken, by means of an apparatus which comprises a thin sheet member having an array of apertures arranged in a multiplicity of mutually perpendicular rows, a plurality of removable color-coded pegs conveniently rounded to be rotatably secured in the holes, arrangement of said holes being indicative of the time of day on one axis and indicative of the medicine to be taken and the dosage on the second axis. Thus, where a person is required, for reasons of health, to take a variety of medicines at differing times of the day or night, then it is a simple matter to program the subject invention whereby the medicine, the dosage and the time are readily and conveniently known.

3 Claims, 5 Drawing Figures

MEDICINE MANAGEMENT DEVICE

This is a continuation of application Ser. No. 721,092, filed Sept. 7, 1976, and now abandoned.

BACKGROUND OF THE INVENTION

The invention described herein relates to a medicine management device for persons who must frequently take dosages of medicines, and more particularly, to a programmer whereby a patient may conveniently know the time, the dose, and the type of medicine he is required to take. It is an improvement of known means for keeping track of medicinal dosages such as that described in U.S. Pat. Nos. 3,278,010 and 3,675,620.

In the treatment of many illnesses it is frequently necessary for a patient to receive several medications at prescribed times over a period of days or weeks. Whether these medications are self-administered or whether they are given in a hospital, doctor's office or clinic by a nurse or a doctor, it is extremely important that there be no mix-up in either the kinds of medicines, in the amounts administered or in the time when they are given. During the pharmacological training of nurses and doctors, great emphasis is placed on the absolute necessity for maintaining perfect accuracy in the administration of medicines and drugs. In many cases the patients life may be at stake and thus there is no room for error. Further, it is vitally important, in certain cases, that a medicine not be ommitted. Certain heart ailments and diabetic conditions, for example, require that a specific medication be taken on an exact schedule.

SUMMARY OF THE INVENTION

It is, therefore, a primary object of the invention to provide a new and improved method for keeping track of the times medicines are to be taken and, further, to show that they have, in fact, been taken.

It is another object of this invention to provide a method for reminding a patient of the kinds of medicines to be taken where a pluraity of conditions are being treated simultaneously.

It is still another object of this invention to provide a ready reminder of the amounts of dosage of each kind of medicine which may be required in the treatment of the illness or condition.

The invention, accordingly, comprises a body portion, a cover portion superimposed over the body portion, indicia representing time zones arranged along the top margin of the body portion, a sheet member having an array of aperatures arranged in mutually perpendicular columns and rows, the columns aligned with the time indicia, the rows superimposed over the time zones at right angles to represent dosages of medicines, a plurality of pegs removably secured within the aperatures, the pegs color-coded to be further indicative of specific medications, the pegs being prepositioned within the aperatures whereby specific dosages of medications which are required to be taken are visibly represented by the pegs.

Further features and objects of the invention will be apparent from an examination of the accompanying drawings which illustrate the invention.

DESCRIPTION OF THE PREFERRED EMBODIMENT

Figure 1:
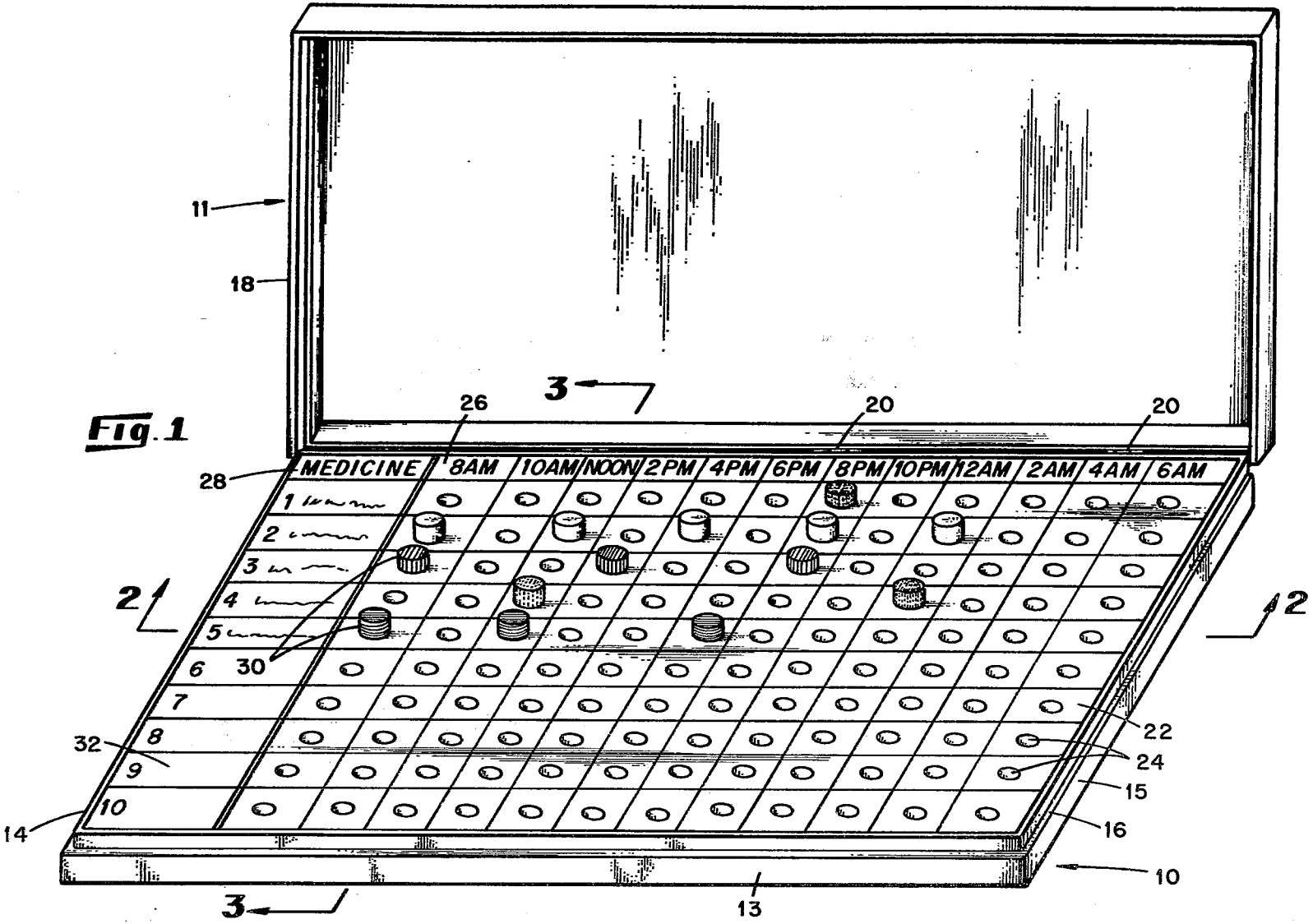
FIG. 1 is a perspective view of a device embodying the invention.
Figure 2:
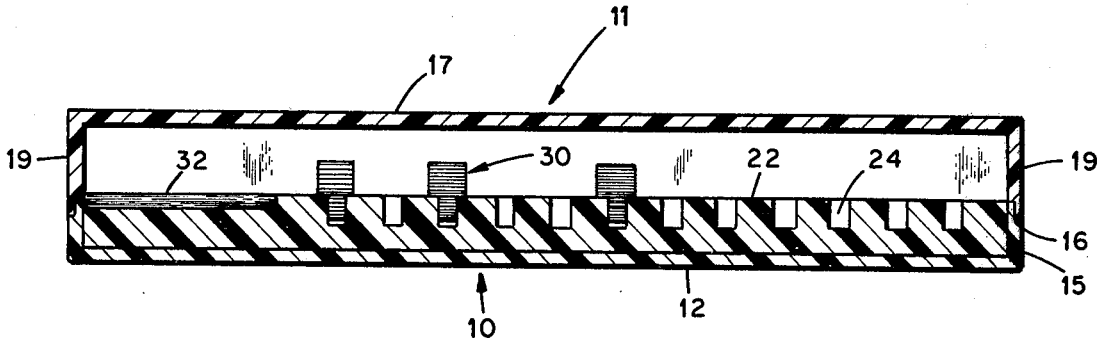
FIG. 2 is a sectional view taken along the line 2—2 of FIG. 1 as viewed in the direction indicated by the arrows.
Figure 3:
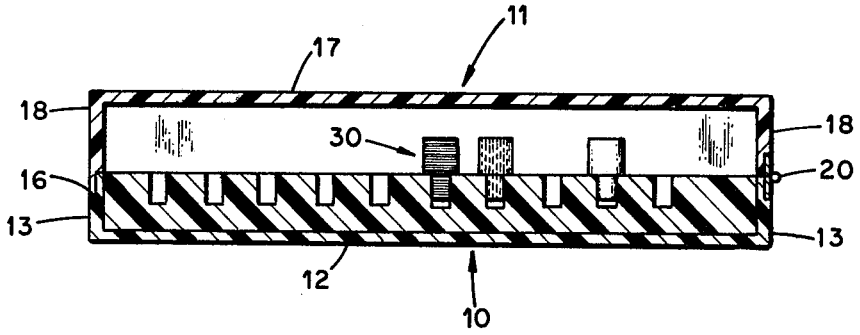
FIG. 3 is a longitudinal section taken upon the line 3—3 of FIG. 1.
Figure 4:
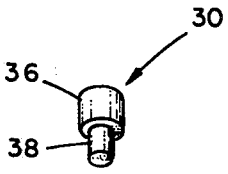
FIG. 4 is a preferred embodiment of the type of peg utilized in this invention.

Having reference to the several drawings in detail, there is illustrated a perspective view of the invention showing a rectangular box comprising a body portion 10 and a cover portion 11 which may be manufactured from wood or metal or formed by molding a plastic composition. The body portion 10 comprises a base 12, side walls 13, a first end wall 14 and a second end wall 15. Side walls 13 and end walls 14, 15 are provided thereof with a rib 16 which serves as an abutment for cover portion 11. The cover portion 11 comprises a thin top panel 17, side walls 18 and end walls 19. Cover portion 11 is removable or may be mounted by hinges 20 to body portion 10.

A sheet member 22 has drilled therein an array of holes 24 aligned in columns and rows, said columns aligned to form time zones, said time zones being represented by indicia along upper margin 26. Said rows are superimposed over said time zones at right angles to represent individual and specific medicines 28 required to be taken during one full day. Thus, where removable pegs 30 are inserted into holes 24 aligned with a particular time zone as shown by indicia in margin 26 and corresponding with a medication listed on pad 32, it is an indication of (1) the type of medicine to be taken or applied as shown in column 28, and (2) the time of day said medicine is to be taken or applied.

Pad 32 can consist of several sheets of paper preprinted with numbers, said numbers aligned to correspond with the rows of apertures 24 whereby specific medications can be noted along with any other pertinent information required by the patient. In another embodiment of the invention, pad 32 can have the numbered rows color-coded to correspond with color-coded pegs 30 as an additional precaution to insure that th proper peg represents a specific medication. Pad 32 does not necessarily have to be color-coded nor made of multiple pages of paper and can comprise any surface upon which the names, dosages, or other pertinent information concerning the medicines may be inscribed, erased and reinscribed.

In the preferred embodiment of the invention, removable pegs 30 comprise an upper larger portion 36 and a lower smaller, rounded portion 38 being of a size which can be easily and conveniently secured or removed from holes 24 drilled into sheet member 22. Said pegs 30 may, if desired, be color-coded whereby identification of said colors with specific medications makes recognition of the medicines easier and more convenient.

Figure 5:
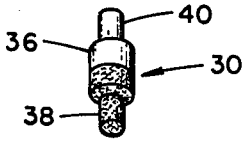
FIG. 5 is a second embodiment of a type of peg which can be utilized in this invention.

In an alternative embodiment, FIG. 5, peg 30 has not only an upper larger portion 36 and a lower smaller, rounded portion 38, but, in addition, has an upper smaller, rounded portion 40 and is painted or displayed in different colors on each half thereof whereby said peg 30, in one position indicates that the medicine has been taken and when in the reverse position shows that the medicine has not been consumed.

For example, peg 30, FIG. 5, could be colored orange on one half thereof to indicate, when the orange end was uppermost, that the medicine had been ingested or applied; having white coloration on the other half thereof to show, when the white end was uppermost, that the dosage was still to be taken.

Thus, the patient would program the device for an entire day with all pegs representing doses to be taken having the white end uppermost. It would then be a simple matter, as the day progressed and medications were taken, to reverse the pegs in the aperatures with the orange end uppermost showing that said dosages had, in fact, been consumed.

In the FIG. 1 drawing of the invention, it is seen that the patient is required to take five different medications. Only one dose or application of medicine No. 1 is required for the day depicted, at 8 PM. Starting at 8 AM, medicine No. 2 is taken every four hours until midnight. Medicine No. 2 has five pegs, indicating five doses of medicine. Medicine No. 3 is taken three times, at 8 AM, 2 PM and 8 PM. Medicine No. 4 is taken at 12-hour intervals, noon and midnight. Medicine No. 5 is taken at 8 AM, noon and 6 PM.

As seen in FIG. 1, medicines listed in column 28 and numbered 1,2,3,4,5 are color-coded yellow, white, red, violet and blue respectively whereby a person utilizing the subject invention can tell at a glance the kind or type of medicine which is required to be taken and the time when said medicine is due to be taken or applied.

It may be seen that several variations are possible with the subject invention. For example, half-size pegs could be used for half doses; pegs inscribed with the number "2" or "3" could indicate double or triple dosages, respectively, when such were prescribed. Other variants may be conceived wherein pegs 30 are sized or color-coded to represent individual and specific dosages of medicines.

An important principle of this invention is that the described pegs be a tangible reminder of an act to be accomplished. Thus, where the patient is required to physically remove or reverse the position of a peg from the programmed medicine management device on the completion of the act of taking medicine, then, in so doing, he has physical and tangible proof that such act was performed.

A preferred embodiment of this invention has been set forth in the description and drawings. These descriptions are used in the generic sense and not for purposes of limitation. Various changes may, therefore, be made therein without departing from the spirit and scope of the invention.

What is claimed is:

1. A medicine management device for use as a visible indicator of the time schedule for the administration of prescribed drugs to a patient, which comprises:

a. a rectangular base member having a flat top surface and edges, said edges designated as top, bottom, right end and left end, said top surface being provided with a plurality of apertures into said base member, said apertures being arranged into orthogonal columns and rows;

b. a cover portion hinged to said base member at said top edge, said cover adapted to enclose and be spaced above said top surface when in a closed position and to expose said top surface when in an open position;

c. indicia placed along at least one of said top edge and said bottom edge of said top surface associated with each of said columns of apertures, said indicia representing time zones spanning a twenty-four hour period;

d. a pad having a multiplicity of selectively removable sheets of paper fitted along at least one of said right end and left end of said top surface associated with each of said rows of apertures, said sheets having preprinted index numbers thereon, said numbers aligned to correspond with said rows of apertures and whereby said sheets of the pad provide for a written designation of specific medications for said patient; and e. one or more color coded peg members removably engaged with one or more of said apertures in said rows as a visible indicator of said specific medication to be administered to said patient at a specific time, said peg members each formed of a large diameter middle portion and two smaller diameter end portions, said end portions being selectively engaged in said apertures in accordance with the medicine taking time schedule zones.

2. A medicine management device as defined in claim 1 and wherein said removable peg members have equivalent dosage values.

3. A medicine management device as defined in claim 1 and wherein said peg members are sized to represent individual and specific dosages of medicine.

* * * * *